US005807028A

United States Patent [19]

Manschot et al.

[11] Patent Number: 5,807,028

[45] Date of Patent: Sep. 15, 1998

[54] BOTTOM SUPPORTING CONSTRUCTION FOR A LEG END OF A DISPLACEABLE JACK-UP PLATFORM

[75] Inventors: Dirk Manschot, Krimpen aan de IJssel; Cornelis Johannes Mommaas, Dordrecht, both of Netherlands

[73] Assignee: Marine Structure Consultants (MSC) B.V., Schiedam, Netherlands

[21] Appl. No.: 663,719

[22] Filed: Jun. 14, 1996

[30] Foreign Application Priority Data

Jun. 16, 1995 [NL] Netherlands ..... 1000585

[51] Int. Cl.[6] ..... E02B 17/02

[52] U.S. Cl. ..... 405/197; 405/224

[58] Field of Search ..... 405/204, 224, 405/196, 197, 198, 203, 208, 224.1

[56] References Cited

U.S. PATENT DOCUMENTS

| | | | |
|---|---|---|---|
| 3,716,994 | 2/1973 | Pogonowski . | |
| 4,662,789 | 5/1987 | Lundberg | 405/205 |
| 4,695,196 | 9/1987 | New | 405/224.1 |
| 4,695,197 | 9/1987 | Watt et al. | 405/204 X |
| 4,695,199 | 9/1987 | Goodacre et al. | 405/224.1 |
| 4,695,201 | 9/1987 | Beskow et al. . | |
| 4,755,082 | 7/1988 | Beskow et al. | 405/224.1 X |
| 4,902,169 | 2/1990 | Sutton | 405/198 X |
| 5,011,335 | 4/1991 | Fjeld | 405/196 X |
| 5,018,904 | 5/1991 | Thomas et al. | 405/196 |
| 5,445,476 | 8/1995 | Sgouros et al. | 405/224 |

FOREIGN PATENT DOCUMENTS

| | | |
|---|---|---|
| 2 004 581 | 4/1979 | United Kingdom . |
| 2 071 740 | 9/1981 | United Kingdom . |

*Primary Examiner*—Tamara L. Graysay
*Assistant Examiner*—Frederick L. Lagman
*Attorney, Agent, or Firm*—IP Group of Pillsbury Madison & Sutro LLP

[57] ABSTRACT

A bottom supporting construction for a leg end of a displaceable jack-up platform including a block-shaped leg end part and a supporting element which can be positioned and anchored on a bottom under water and which is provided with a supporting face for a leg end, while a resilient sealing collar, closed upon itself, and a buffer, which in unloaded condition have a height less than that of the sealing collar, are arranged so that when the leg end comes to rest on the supporting element, a space closed off from the environment is formed between that leg end, that sealing collar and the supporting face, and closable discharge is present for enabling water to be discharged from that space. If so desired, upwardly extending support can be arranged on the supporting face, which receive the leg end at least locally with relatively close abutment, so that that support can support the leg end in horizontal direction.

15 Claims, 2 Drawing Sheets

BOTTOM SUPPORTING CONSTRUCTION FOR A LEG END OF A DISPLACEABLE JACK-UP PLATFORM

BACKGROUND OF THE INVENTION

The invention relates to a bottom supporting construction for a leg end of a displaceable jack-up platform, of which bottom supporting construction a block-shaped leg end forms a part.

Such bottom supporting constructions are known from, inter alia, U.S. Pat. Nos. 2,589,146; 3,011,467 and 3,343,371. Because of their mobility and the possibility of placing them above a storage tank or other constructions, displaceable jack-up platforms are extremely interesting for developing economically marginal and relatively small oil fields. In all those cases, the cooperation of the leg ends with the seabed or a construction disposed on that seabed is of crucial importance, not only because this requires taking up horizontal, vertical and, in particular, rotational forces, but also because the mobile and self-installing character of the jack-up platforms should be maintained. Accordingly, much development work has been done to design leg ends which have a particular resistance to rotation when resting on or in the seabed. However, that operation of taking support should take place in a great variety of ground types, so that the resistance that is actually experienced may vary within a wide range. If a coupling is to be made with a construction disposed on the seabed, all sorts of mechanical connections should be made with all the constructional and operational problems involved, considering the site of operation, on or adjacent the seabed.

SUMMARY OF THE INVENTION

The object of the invention is to improve a bottom supporting construction of the type described in the opening paragraph of the foregoing background section so that in each case, a positioning can be realized which is relatively simple, yet, from a point of view of forces, particularly effective and optimally operative. In addition, the invention aims at realizing that object by relatively cheap means.

In accordance with the invention, this object is realized if the bottom supporting construction further comprises a supporting element which can be positioned and anchored on a bottom under water and which is provided with a supporting face for a block-shaped leg end, while a resilient sealing collar, closed upon itself, and buffer means, which in unloaded condition have a height less than that of the resilient sealing collar, are arranged so that when the block-shaped leg end comes to rest on the supporting element, a space closed off from the environment is formed between that leg end, that sealing collar and the supporting face, and closable discharge means are present for enabling water to be discharged from that space.

Through these relatively simple measures it is provided that when a leg end, during the positioning thereof, approaches the supporting element, a water cushion is formed in the space within the sealing collar, which on the one hand damps the vertical, downward movement of the leg end and on the other takes up the impact load on the supporting element so as to be evenly distributed over the surface of the supporting face within the sealing collar. When the jack-up platform is subsequently elevated and lifted from the water, the weight thereof is transferred to the supporting element by means of the water cushion located within the space between supporting face, sealing collar and leg end, which space is then closed off from the environment. After the jack-up platform is brought to its proper height, the discharge means are opened, so that the buffer means become fully active and thus substantially transfer the weight of the jack-up platform with legs to the supporting element. After this, the discharge means are closed again, and the space, closed off from the environment, remains entirely filled with water. This has the added benefit that under weather conditions resulting in bending forces on the legs of the jack-up platform, whereby the leg ends tend to tilt and come loose one-sidedly from the buffer means, there is opposition from the water cushion in the closed-off space, which opposes enlargement of the closed-off space and hence forms, as it were, a pull connection.

In this manner, a reliable connection and support are obtained, having a clearly defined stiffness and a behavior which, in terms of effectiveness, is comparable with a mechanically coupled connection.

In accordance with a further embodiment of the invention, it is preferred that upwardly extending supporting means be arranged on the supporting face, which provide that the block-shaped leg end is at least locally received with relatively close abutment, the arrangement being such that those supporting means can support in a horizontal direction a block-shaped leg end resting on the supporting face. Through these measures, horizontal forces exerted on the jack-up platform, for instance caused by heavy weather conditions, can be taken up at the leg ends in an improved manner, in that when such additional supporting means are present, the horizontal forces can be taken up by those supporting means, with the buffer means and the water cushion taking up the rotational and vertical pressure forces.

In order to facilitate the accurate positioning of the legs at the desired location, in accordance with a further embodiment of the invention, it is preferred that, at least above the supporting means, the supporting element be provided with centering and guiding means for the block-shaped leg end. By taking these measures, a descending leg end, after having been brought within the centering and guiding means, is forced into exactly the proper position.

In accordance with a further embodiment of the invention, it is proposed that the supporting element be designed as a box-shaped construction, open towards the top, having an inside bottom forming the supporting face, and a circumferential wall extending upwards from the inside bottom, which circumferential wall has a height greater than that of the sealing collar and which can receive the block-shaped leg end with greater play than the supporting means. These features provide that when the upper edge of the circumferential wall is reached by the leg end during the descent of a leg, a first damping is already obtained in an additionally advantageous manner by the water which is to be forced out between the leg end and the circumferential wall.

The various additional effects discussed hereinabove can be combined in an advantageous manner if, in accordance with a further embodiment of the invention, the circumferential wall is at least three locations provided with supporting means which blend into centering and guiding means projecting above the circumferential wall. Thus, a descending leg is first centered and guided towards the desired position, whereupon a first damping follows and the leg, locked in horizontal direction, forms a subjacent water cushion, whereupon a further damping and a distributed absorption of the impact force with which the leg comes down, take place via that water cushion as is further described hereinabove. In this connection, it is preferred that the buffer means consist of at least three buffer blocks, manufactured from steel reinforced rubber.

To be able to cause the excess water to flow away in a simple manner, after the absorption of the impact load as the leg comes down, for creating the additionally advantageous pull connection, in accordance with a further embodiment of the invention it is preferred that the closable discharge means be designed as a conduit in the supporting element or the block-shaped leg end, which conduit comprises a closing element.

BRIEF DESCRIPTION OF THE DRAWINGS

Hereinafter, the bottom supporting construction according to the invention will be specified with reference to an embodiment shown, by way of example only, in the accompanying drawing. In this drawing.

DETAILED DESCRIPTION

Figure 1:
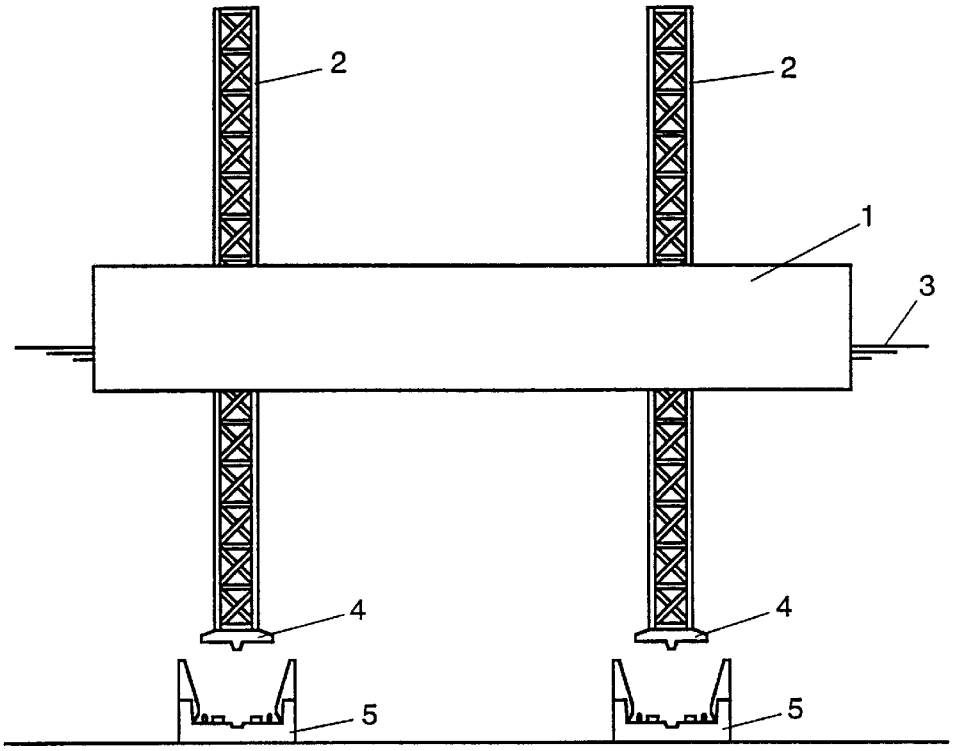
FIG. 1 schematically shows in side elevation a jack-up platform with legs descending towards supporting elements.

FIG. 1 shows a jack-up island 1 comprising at least three legs 2, displaceable in vertical direction relative to the jack-up platform. The jack-up platform 1 has sufficient buoyancy for being displaced while floating. When the jack-up platform 1 has arrived at its destination, the legs are lowered to take support on the seabed, whereupon the jack-up platform 1 is elevated along the legs 2 to a position at a certain distance above the water surface 3.

The legs 2 have block-shaped ends 4 which may consist of a hollow metal body capable of being filled with ballast, for instance water. The manner in which a leg end 4 takes support on a seabed highly depends on the type and composition of the ground. For instance, the leg end 4 may remain in position on the bottom or sink therein, partly or wholly. To prevent this problem, in accordance with the invention, supporting elements 5 are used, which are positioned on or in the bottom and, if desired, anchored therein or form part of a bottom-raising supporting construction, storage tank or a like apparatus.

Figure 2:
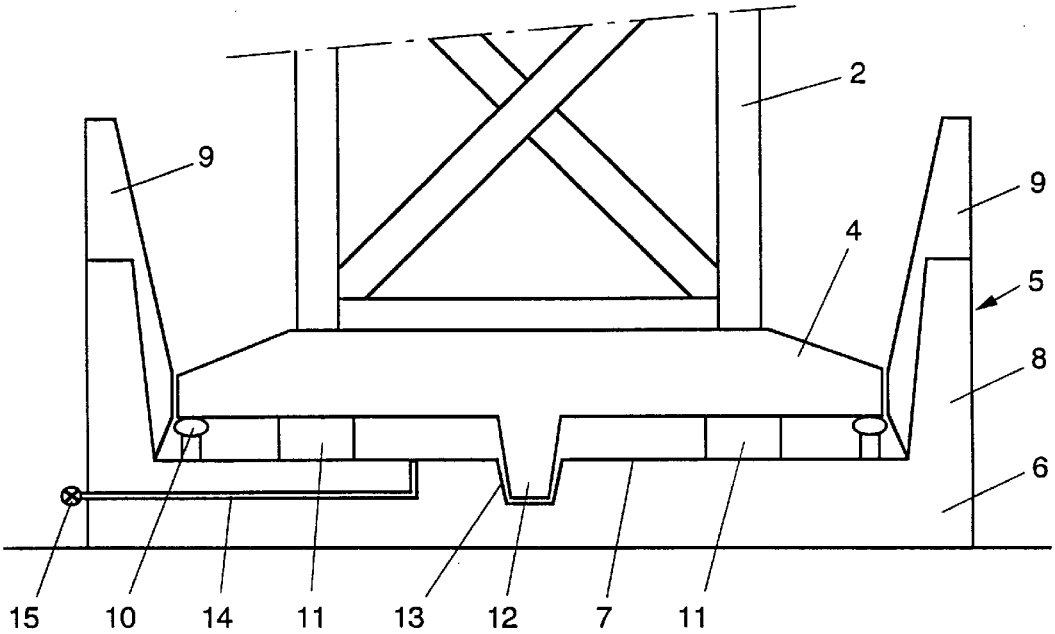
FIG. 2 shows, to an enlarged scale, a supporting element with a leg end positioned thereon.

As appears most clearly in FIG. 2, the supporting element 5 comprises a bottom part 6 having a supporting face 7 for the leg end 4. Extending upwards from the bottom part 6 is a circumferential wall 8, extending all around and locally bearing centering and guiding means 9. The circumferential wall has a slightly conical inner wall and is dimensioned so that a leg end 4 fits therein with ample play. The centering and guiding means 9 extend above the circumferential wall on the one side and extend inside that wall on the other, where it is provided that a leg end 4 positioned in the centering and guiding means 9 is confined and supported in horizontal direction. Further, the centering and guiding means 9 are provided with an inner wall which is more inclined than the circumferential wall 8.

Provided on the supporting face 7 and adjacent the circumferential wall is a resilient sealing collar 10, extending all around. The sealing collar 10 is positioned so that when a leg end 4 is disposed on and in the supporting element 5, the collar always has its entire circumference contacting the bottom face of that leg end. Further, provided within the sealing collar 10 and on the supporting face 7 are a number of buffer blocks 11, for instance manufactured from steel-reinforced rubber. In this connection, it is observed that the sealing collar 10 and the buffer means 11 may also be fixed to the leg end 4, which could be preferred for new jack up platforms to be built, while in the exemplary embodiment, existing jack-up platforms are without modifications suitable for having the legs cooperate with supporting elements.

The leg end is provided with a conical stud 12 fitting in a corresponding recess 13 in the bottom part 6, which further accommodates a discharge conduit 14 opening at one end thereof within the sealing collar 10 and at the other end thereof outside the circumferential wall 8, where, by means of a tap 15, the conduit is closable relative to the environment.

Starting from the situation shown in FIG. 1, where the leg ends 4 approach the supporting elements 5, the operation of the bottom supporting construction shown according to the invention will now be further discussed.

When a leg end 4 descends further than is shown in FIG. 1, it will be guided into the circumferential wall 8 by the centering and guiding means 9. As soon as the leg end 4 comes within the circumferential wall 8, extending all around, a first damping of the impact accompanying the positioning of the leg takes place. This first damping results from the fact that water located under the leg end should be forced out through the circumferential slot between the leg end 4 and the circumferential wall 8. The positioning of a leg is a dynamic process, i.e. the descending leg can be moved not only downwards, but also upwards, although to a lesser degree. For that latter movement, the circumferential plate has as a result that water should be sucked in, which also means a damping of that less desired upward movement.

As may appear from FIG. 1, the top face of the sealing collar 10 projects above that of the buffer blocks 11. Thus, the bottom face of the leg end 4, as it descends further within the circumferential wall 8, with that leg end 4 then ending up between the retaining faces of the centering and guiding means 9, will contact the top face of the sealing collar 10. At that moment, an amount of water is trapped within the sealing collar 10, which water forms a cushion, providing a second damping of the impact when the leg 2 is being positioned. In this situation, the jack-up platform 1 is brought to the desired height above the water surface 3.

When this operation is completed, then the tap 15, closed at first, is opened, so that water can flow off and at least a part of the weight of jack-up platform 1 comes to rest, by its legs 2, on the buffer blocks 11. After this, the tap 15 is closed again.

Thus, a leg 2 is accurately positioned at the desired location in a particularly controlled and, as far as impact loads are concerned, damped manner. Moreover, not only a proper support in vertical direction is provided for, but also a proper absorption of horizontal forces that may be caused by wave action, wind load or other external influences on the jack-up platform and the legs. These horizontal forces also cause a moment load, which tends to tilt the leg ends 4. If that occurs, then the water cushion again provides an evenly distributed absorption of forces. If the forces are such that the leg end 4 threatens to come loose, on one side thereof, from a buffer block 11, that would mean an enlargement of the space enclosed by the sealing collar 10. In that case, a partial vacuum would be created, as it were, in that space closed off from the environment. This is however opposed by the water confined in that space, which water retains the leg end 4 through pulling action, as it were. In this manner, a connection is obtained which, as far as behavior is concerned, is comparable with a mechanical connection, although without the complicated operations that have to be performed for making a mechanical connection on the seabed.

It is a matter of fact that a great many modifications and variants are possible within the framework of the invention as laid down in the appended claims. For instance, lattice legs are shown in the drawing, this may of course also be any other type of legs having any cross section. Further, the discharge conduit 14 is shown to be in the bottom part 6 of the supporting element 5. This conduit may also lead to the environment from the space within the sealing collar 10 through the leg end 4. Further, if so desired, the circumferential wall 8 and the centering and guiding means 9 can be omittted. It is already observed that, contrary to what is shown in FIGS. 1 and 2, the sealing collar 10 and the buffer blocks 11 may also be attached to the leg end. It is also possible that both on the leg end and on the supporting face, a sealing collar and buffer means are provided, contacting each other during positioning. A further possibility is that the sealing collar is provided on the leg end while the buffer means are provided on the supporting face, or the other way round. If so desired, several sealing collars, closed upon themselves, can also be present, inter alia depending on the surface of the leg end, which sealing collars then each comprise closable discharge means. At any rate in the case where several sealing collars are present, it is also possible to dispose the buffer means at least partly outside the sealing collar or sealing collars, contrary to what is shown in FIGS. 1 and 2.

Figure 3:
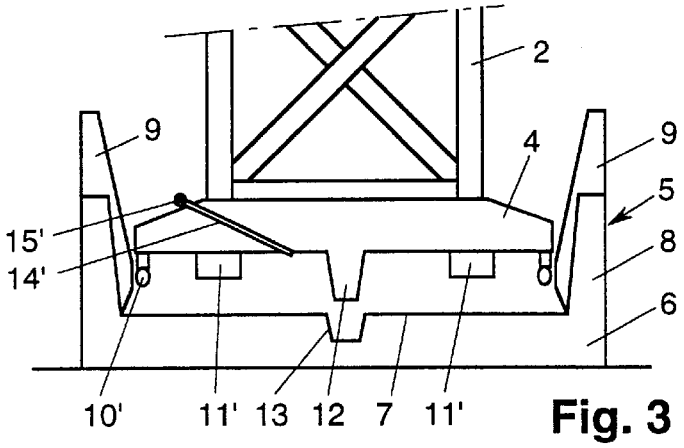
FIGS. 3–5 are enlarged scale views, similar to FIG. 2 but showing alternative constructions.
Figure 4:
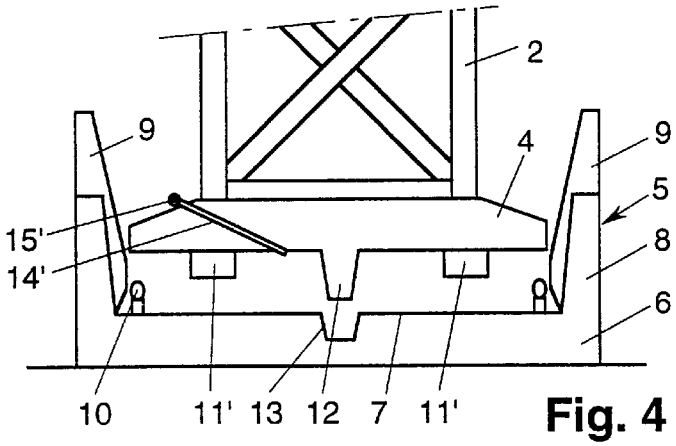
Figure 5:
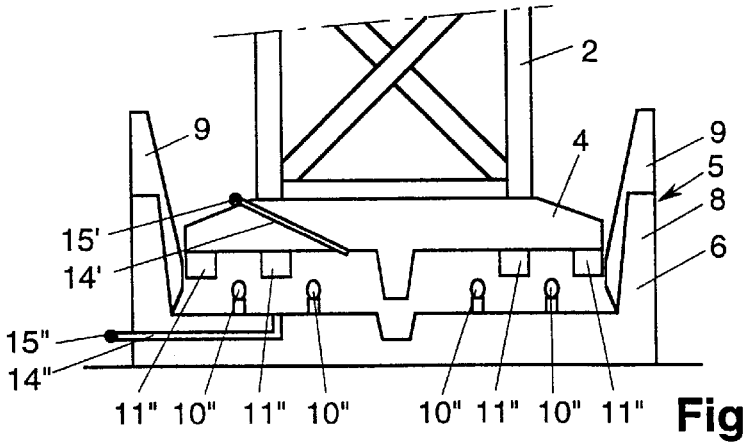

In FIG. 2, the buffer means is shown deposed inside the sealing collar. In FIG. 3, corresponding to FIG. 2, the sealing collar 10' and the buffer blocks 11' are fixed on the leg ends instead of the supporting face. Moreover, the closable discharge means 14', 15' are designed as a conduit in the block-shaped leg end. FIG. 4 differs from FIG. 3 in that the sealing collar 10 (as in FIG. 2) is fixed on the supporting face. FIG. 5 differs from FIG. 4 in that the buffer means 11" are partly disposed outside the sealing collar(s) 10" and in that several sealing collars 10" are present each comprising closable discharge means (14', 15' and 14", 15") for each compartment enclosed by one sealing collar (central compartment by discharge means 14') or by two sealing collars (ring-like compartment by discharge means 14").

We claim:

1. A bottom supporting construction for a leg end of a displaceable jack-up platform, comprising:

a block-shaped leg end;

a supporting element which can be positioned and anchored on a bottom under water and which is provided with a supporting face for said block-shaped leg end;

at least one resilient sealing collar, each closed upon itself buffer means, which in an unloaded condition have a height which is less than that of said resilient sealing collar, said buffer means being arranged so that when said block-shaped leg end comes to rest on said supporting element, a space which is closed off from the environment is formed between said leg end, said sealing collar and said supporting face; and closable discharge means arranged for enabling water to be discharged from said space.

2. The bottom supporting construction according to claim 1, wherein:

upwardly extending supporting means are arranged on said supporting face, said upwardly extending supporting means providing that block-shaped leg end is at least locally received with relatively close abutment, said supporting means being arrange to support in a horizontal direction said block-shaped leg end, resting on said supporting face.

3. The bottom supporting construction according to claim 2, wherein:

at least above said supporting means, said supporting element is provided with centering and guiding means for said block-shaped leg end.

4. The bottom supporting construction according to claim 2, wherein:

said supporting element is a box-shaped construction, open towards the top, having an inside bottom forming said supporting face, and a circumferential wall extending upwards from said inside bottom, which circumferential wall has a height which is greater than that of said sealing collar and which can receive said block-shaped leg end with greater play than said supporting means.

5. The bottom supporting construction according to claim 4, wherein:

said circumferential wall is in at least three locations provided with elements of said supporting means, which blend into centering and guiding means projecting above the circumferential wall.

6. The bottom supporting construction according to claim 1, wherein:

said buffer means comprise at least three buffer blocks, manufactured from steel-reinforced rubber.

7. The bottom supporting construction according to claim 1, wherein:

said closable discharge means comprise a conduit in one of said supporting element and said block-shaped leg end, said conduit comprising a closing element.

8. The bottom supporting construction according to claim 1, wherein:

said block-shaped leg end is centrally provided with a frustro-conical stud fitting in a corresponding recess provided in said supporting face.

9. The bottom supporting construction according to claim 1, wherein:

said sealing collar is fixed on said supporting face.

10. The bottom supporting construction according to claim 1, wherein:

said sealing collar is fixed on said leg end.

11. The bottom supporting construction according to claim 1, wherein:

said buffer means are fixed on said supporting face.

12. The bottom supporting construction according to claim 1, wherein:

said buffer means are fixed on said leg end.

13. The bottom supporting construction according to claim 1, wherein said buffer means are disposed inside said sealing collar.

14. The bottom supporting construction according to claim 1, wherein:

said buffer means are at least partly disposed outside of said sealing collar.

15. The bottom supporting construction according to claim 1, wherein:

said at least one sealing collar comprises a plurality of like sealing collars, each comprising a respective said closable discharge means.

* * * * *